United States Patent [19]

Williams

[11] Patent Number: 4,576,539

[45] Date of Patent: Mar. 18, 1986

[54] WHEELCHAIR PASSENGER LIFT APPARATUS FOR TRANSIT STATIONS

[75] Inventor: Harold R. Williams, Maple Valley, Wash.

[73] Assignee: Lift-U-Inc., Kent, Wash.

[21] Appl. No.: 571,903

[22] Filed: Jan. 17, 1984

[51] Int. Cl.[4] ..... B66B 11/04

[52] U.S. Cl. ..... 414/391; 187/8.52; 187/8.65; 187/8.69; 187/12; 187/17; 414/399; 414/921

[58] Field of Search ..... 414/373, 399, 595, 921, 414/349, 350, 351, 391; 187/8.52, 8.65, 8.69, 17, 10, 12, 19

[56] References Cited

U.S. PATENT DOCUMENTS

| | | | |
|---|---|---|---|
| 1,634,854 | 7/1927 | Scollard . | |
| 2,059,059 | 10/1936 | Thompson . | |
| 2,702,678 | 2/1955 | Flock, Jr. | 244/137 |
| 3,229,788 | 1/1966 | Booth | 187/12 X |
| 3,521,775 | 7/1970 | Vermette . | |
| 3,737,009 | 6/1973 | Stoddard | 187/8.52 X |
| 3,794,193 | 2/1974 | Fleenor . | |
| 3,888,463 | 6/1975 | O'Brien | 254/10 |
| 3,966,022 | 6/1976 | Cheney | 187/12 |
| 4,063,619 | 12/1977 | Drews | 187/17 |
| 4,124,100 | 11/1978 | Hawks | 187/9 |
| 4,347,030 | 8/1982 | Kingston | 414/556 |

*Primary Examiner*—Robert G. Sheridan

*Attorney, Agent, or Firm*—Christensen, O'Connor, Johnson & Kindness

[57] ABSTRACT

A curbside lift apparatus for transferring wheelchair passengers to and from trains and public transit vehicles using existing pedestrian passenger entryways. Free-standing base wall structures support parallel guide tracks inclined toward the transit vehicle, such that a passenger lift car guided by such tracks and carried by chain and sprocket elevator means between the wall structures advances toward and retracts from the passenger vehicle in being raised and lowered, thereby shortening the crossover distance between vehicle passenger deck and lift car spanned by a hinged bridge on the lift car lowered to the deck. Simplified, enclosed, vandal-resistant construction of the mechanical apparatus and an automatic sequencing control system for the same accessible only to an authorized attendant assure prompt, safe operation of the apparatus under various contingencies.

14 Claims, 16 Drawing Figures

Fig. 6.
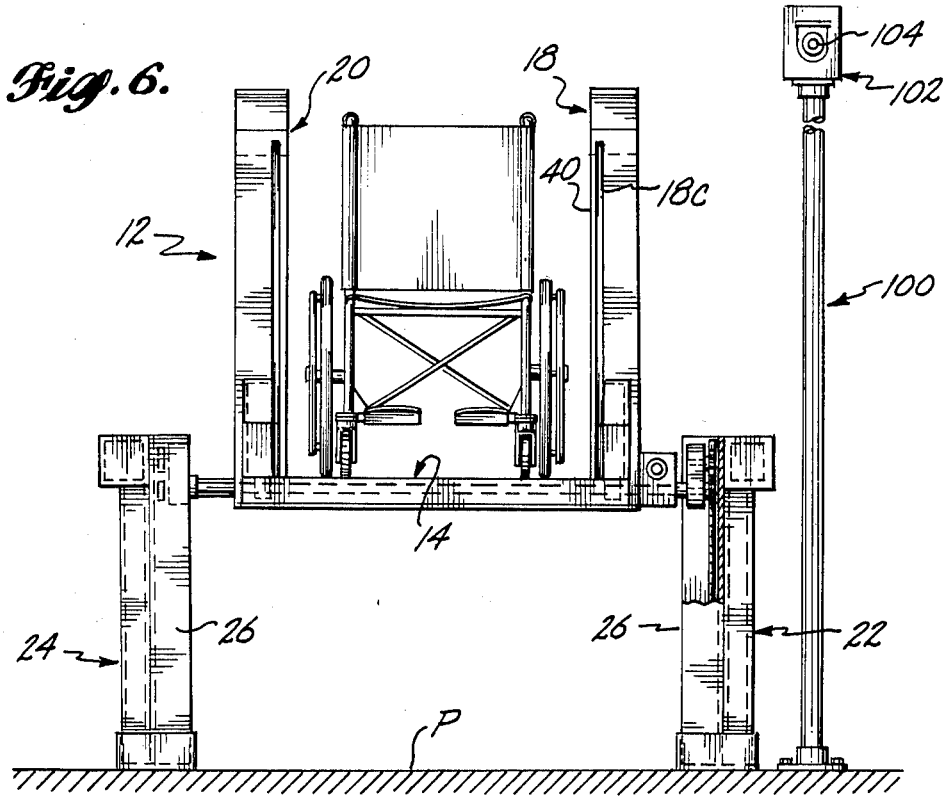
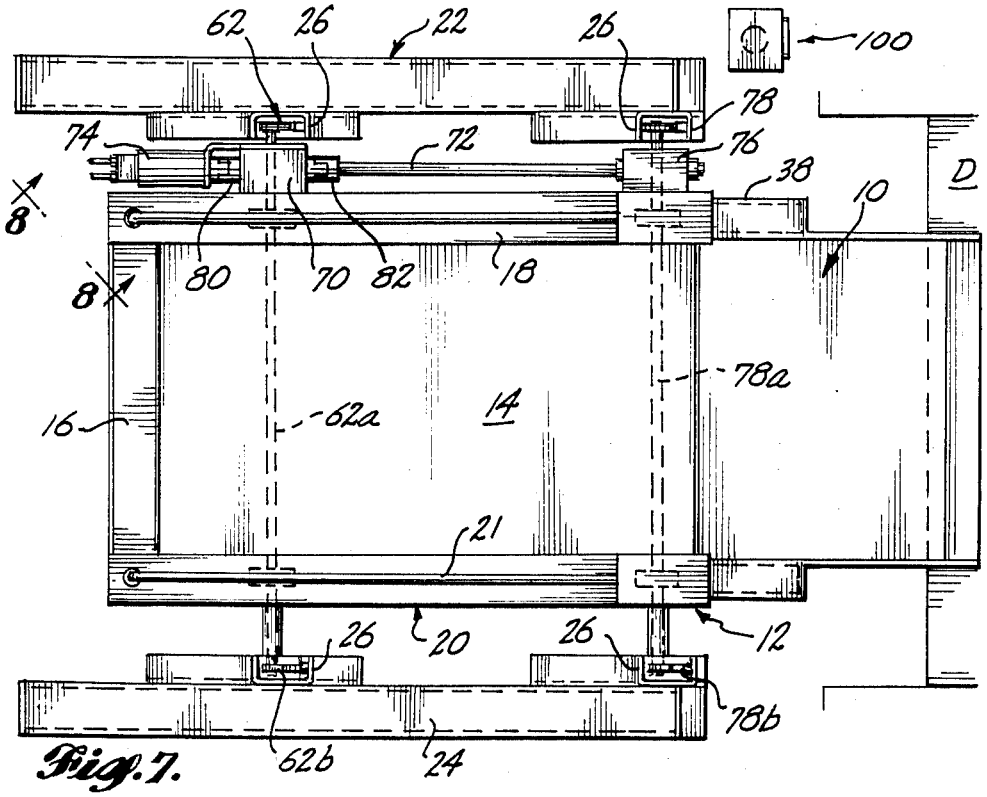
Fig. 7.

Fig. 15.
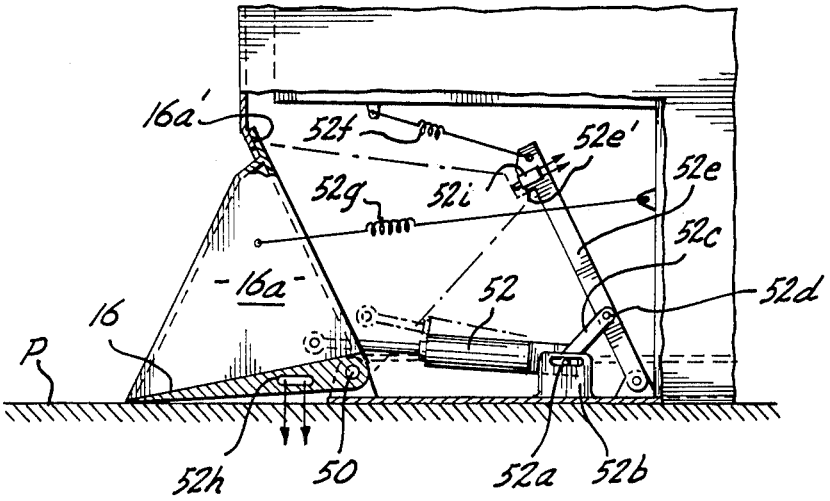
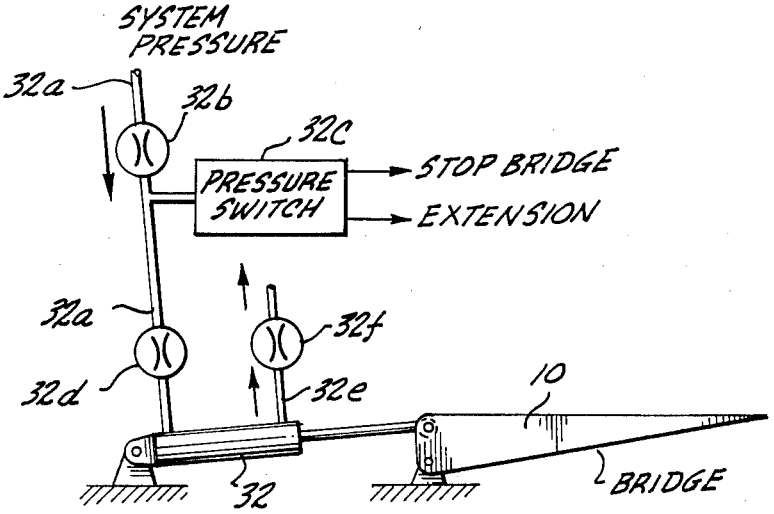
Fig. 16.

WHEELCHAIR PASSENGER LIFT APPARATUS FOR TRANSIT STATIONS

BACKGROUND OF THE INVENTION

This invention relates to an improved transit station lift apparatus by which wheelchair occupants and other disabled persons are given the means to enter and leave transit vehicles safely as regular passengers with minimum inconvenience and without undue time loss to the transit system. The invention is herein illustratively described by reference to its presently preferred embodiment; however, it will be appreciated that certain modifications and changes therein may be made with respect to details without departing from the essential features involved.

With the growing awareness and sensitivity of the public and public transit authorities to the needs of wheelchair occupants and other disabled persons to share in the use of existing public transit systems and to the public benefit of having them do so, major efforts have been mounted in the search for practical and safe systems by which common carrier vehicles such as buses and trains may be utilized over their regular routes and at regular stopping points or stations to carry these individuals while accommodating regular passengers. For obvious reasons, the alternative of providing a separate fleet of special vehicles in a taxi-like service to disabled persons has been unsatisfactory because of the high costs; whereas, attempts to provide regularly scheduled service with such vehicles have also met with cost limitations, especially when attempting to provide reasonably frequent scheduled runs and adequate area coverage.

A further object of this invention is to devise a relatively low-cost apparatus installed at the transit station or stop so as to serve all transit vehicles picking up and discharging passengers there including disabled passengers in wheelchairs. A related object hereof is to provide apparatus of this nature occupying a minimum of ground space at the transit station or stop and readily operable by the vehicle operator or conductor with the vehicle stopped to receive or discharge such passengers.

A further and more specific object hereof is to devise such lift apparatus of relatively simple construction, essentially vandal-proof and provided with a control system restrictively accessible only by authorized persons such as a bus driver or conductor. A related purpose is to provide such apparatus with a control means conveniently operable from the vantage point of a transit vehicle entryway by a trained person such as a train conductor, thereby assuring that the most frail and most uncoordinated handicapped person in a wheelchair may safely and quickly board and leave the transit vehicle.

Still another object hereof is to devise a lift apparatus easily accessed from either end and serving also as a safety enclosure available to the wheelchair occupant while waiting for arrival of the next train or bus vehicle and while being transferred between transit station platform and vehicle passenger deck. A related objective is to provide in such a lift apparatus an elevator system in which a normally retracted bridge, extendable to the vehicle passenger deck from the lift car platform, may be made of minimum projecting length deployed as a bridge so as to minimize the structural requirements of the bridge and the length of open span the wheelchair passenger must traverse in moving between lift car and transit vehicle deck.

SUMMARY OF THE INVENTION

As herein discussed, the wheelchair lift apparatus comprises a lift car normally in lowered position with its platform boarding ramp at one end extended to the ground so as to accommodate a wheelchair passenger desiring to enter or leave. A bridge at the opposite end of the lift car is normally in upraised retracted position extending transversely between opposite side walls of the car so as to form therewith three sides of a protective enclosure. Once a transit vehicle has been brought to a stop with its passenger entryway in registry with the lift apparatus and the entryway doors opened, the vehicle driver accesses a vandal-secure control system of the apparatus in order to retract the boarding ramp of the lift car and thereby form the fourth side of the protective enclosure. This step of operation starts an automatic control system sequence. In that sequence, the lift car is next elevated to a stop near deck level of the transit vehicle, whereupon the bridge is extended through the entryway until its end rests on the vehicle deck to span between the lift car and the deck.

A wheelchair passenger already aboard the vehicle wishing to depart simply crosses the bridge to the lift car platform. At that point, the vehicle driver or conductor starts an automatic reverse sequence through the apparatus control system. The bridge is first raised, the lift car lowered to ground level, and the boarding ramp then extended from the lift car platform.

In the preferred embodiment, both the lift car boarding ramp and bridge are mounted for extension and retraction by hinging action employing side-mounted hydraulic jacks accommodated between dual panels of the lift car sidewalls. A cover or cowl over the jack operating the bridge telescopes into the lower corner portion of the lift car side wall.

Desired minimizing of bridge length is achieved by a lift car elevator system with sloping guide tracks which advance the lift car horizontally toward the transit vehicle entryway as the lift car is being raised to passenger vehicle deck level position. Sliders supporting the lift car engage the sloping guide tracks in an arrangement also stabilizing and steadying the lift car in its movements up and down along the guide tracks. In order to maintain the lift car platform horizontal as it is raised and lowered, traveling sprockets carried by the sliders and commonly driven in rotation by interconnected lift car support shafts, engage and run on stationary sprocket chains. Such chains, held stretched along the inclined guide tracks, engage two mutually adjacent sprockets on each slider in a double reversal of the chains as a means of providing a quietly smooth lift car device.

These and other features, objects and advantages of the invention will become more fully evident as the description proceeds with reference to the accompanying drawings.

BRIEF DESCRIPTION OF THE DRAWINGS

FIG. 6 is an end elevation of the apparatus appearing in FIG. 5 as viewed from the open entryway of the passenger train or other vehicle;

FIG. 7 is a plan view of the apparatus as shown in FIGS. 5 and 6;

FIG. 15 is a schematic of the ramp and the means for actuating the same, along with switch means employed in the associated control system;

FIG. 16 is a schematic of the bridge and the means for extending and retracting the same, along with switch means employed in the associated control system.

DETAILED DESCRIPTION OF THE DRAWINGS

Figure 3:
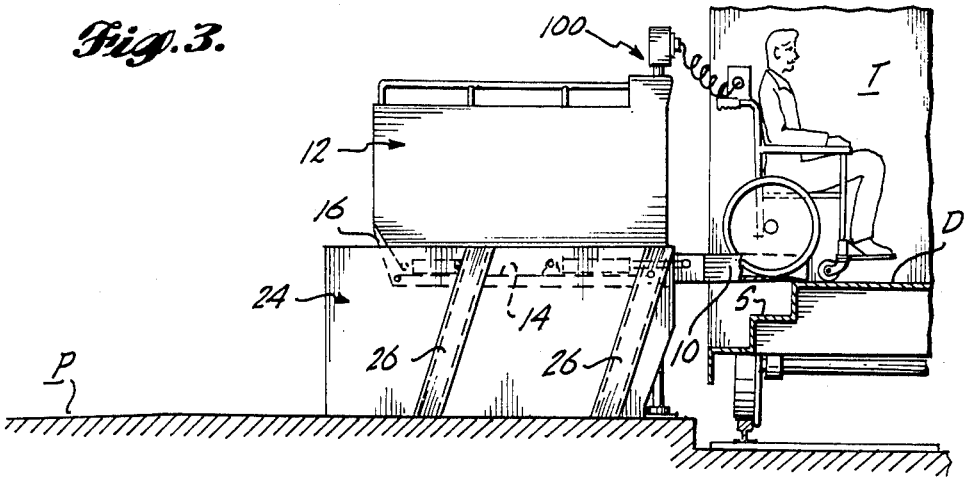
FIG. 3 is a side elevation similar to FIG. 3, but with the lift car fully elevated to passenger transfer position, with its bridge extended to the train deck and with the wheelchair passenger shown boarding the train using the bridge.

In the illustrated application of the invention, the lift apparatus for wheelchair passengers is depicted for use on a train station platform P. The train is shown in the view by depicting its wheels W riding on tracks R extending parallel to the curb edge of the platform P and by its passenger steps S open in its open entryway leading upwardly to the passenger deck D. The lift apparatus A is mounted adjacent to the edge of platform P oriented endwise toward the tracks. The widths of the entryways in most existing trains and other transit vehicles are already sufficient or can be made sufficient to accommodate a wheelchair moved through the entryways. The lift apparatus bridge 10, which must be traversed by the wheelchair passenger in boarding and leaving the train, is made only a little wider than a wheelchair and is therefore extendable into the entryway with the lift car in its elevated passenger transfer position as depicted in FIG. 3. The span length of bridge 10 is, of course, made sufficient to extend to the passenger deck D from the adjacent end of the lift platform 14 of lift car 12 with the lift car elevated.

Figure 1:
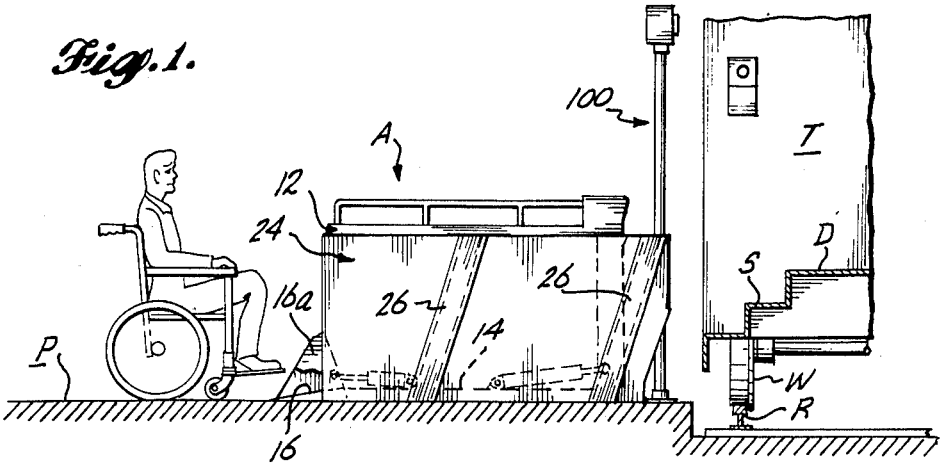
FIG. 1 is a side elevation of the lift apparatus with its lift car in lowered position and its ramp extended to the station platform for receiving a wheelchair passenger desiring to board the train as depicted in the view.
Figure 2:
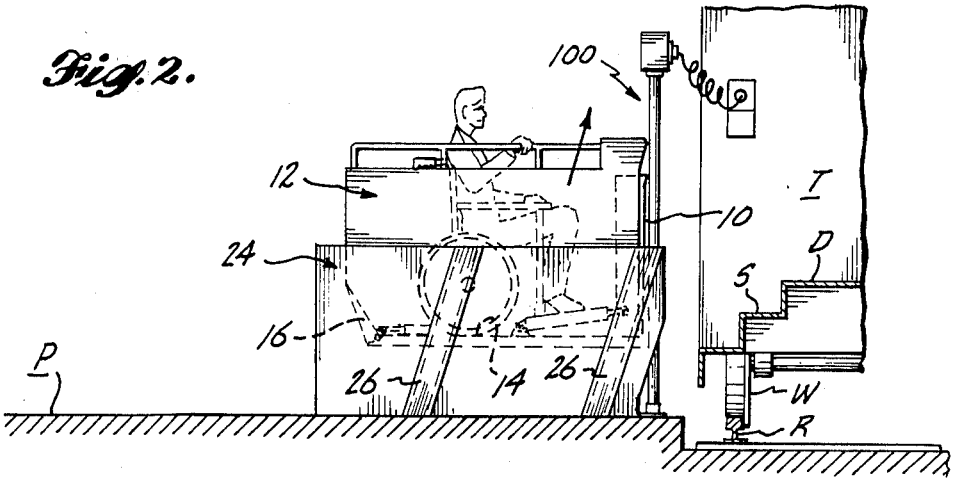
FIG. 2 is a side elevation similar to FIG. 1, but with the lift car partially elevated toward passenger transfer position.
Figure 4:
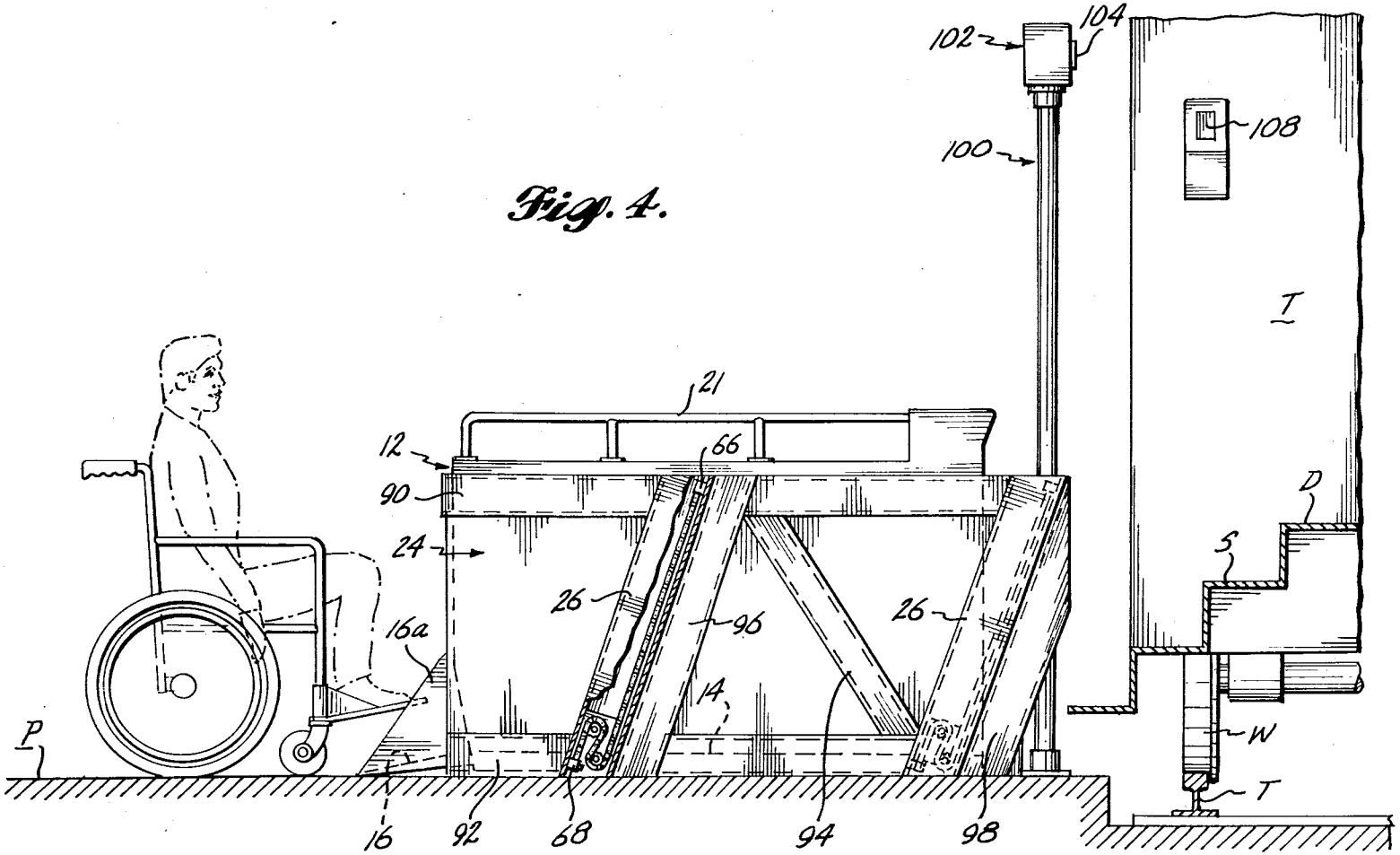
FIG. 4 is a side elevation similar to FIG. 1, but at an enlarged scale, with parts broken away to show apparatus frame structure and lift car elevator guide tracks and drive mechanism.

With the lift car 12 in its lowered position as depicted in FIG. 1, the lift platform 14 rests directly upon the station platform P or upon an intervening base or support (not shown) but, in any event, at a very low level above the station platform so that a ramp 16 of practical length lowered or extended to contact the platform gives the wheelchair passenger easy access to the lowered lift car over a ramp of shallow slope. With the lift car 12 lowered to station platform level, bridge 10 at the opposite end of the lift car is in its upraised or retracted positions as will more fully appear as the description proceeds. Meanwhile, it will be noted in FIG. 2 that both the ramp 16 and the bridge 10 are maintained in fully retracted (upraised) position during raising and lowering of the lift car, and with or without a passenger occupying the car. The lift car bridge 10 and ramp 16 serve as end walls, and extend between opposite side walls 18 and 20 of the lift car (FIG. 6) to protectively surround the wheelchair occupant during raising and lowering of the lift car. Optional details such as handrails 21 (FIG. 4) extending along the upper edges of the side walls 18 and 20 and other functional or aesthetic features may be employed suiting the engineering, appearance, and safety standards of the manufacturer and/or user.

Lift car 12 is mounted and guided to be raised and lowered by and between transversely spaced parallel upright frame wall structures 22 and 24, each with a pair of parallel lift car guide tracks 26 (FIG. 6). Lift car support sliders 28 (FIG. 8) slidably engaging these tracks are themselves supported and driven in unison so as to maintain the lift platform always level as it is raised and lowered. Such guide tracks are inclined in parallel toward the train right-of-way at a substantial acute angle such as 75° relative to the station platform P. Thus, as the lift car is raised from its lowered position set back a certain safe distance from the edge of station platform P, such as to accommodate a person who may happen to be trapped there as a train is arriving or leaving, the lift car is advanced horizontally toward the train right of way. As a result, the span which must be bridged between the train deck D and the adjacent edge of the raised lift platform is minimized. A short span simplifies and economizes in the bridge structure needed to support load, and it also permits the train entryway to provide safe side and overhead shelter for the wheelchair passenger during crossing of the short bridge span.

Lift car 12, in more specific detail, comprises a hollow bottom structure with spaced top and bottom panels forming the lift platform 14. Upright side walls 18 and 20 are appropriately joined with cantilever structural rigidity to opposite side edges of platform 14. Such side walls are of dual-panel hollow construction, as are those of the apparatus support walls to be described, so as to accommodate functional components of the lift car such as hydraulic hoses, fittings, solenoid valves, motor switches and related components. These physical arrangements within the side walls are not important and may vary.

Figure 13:
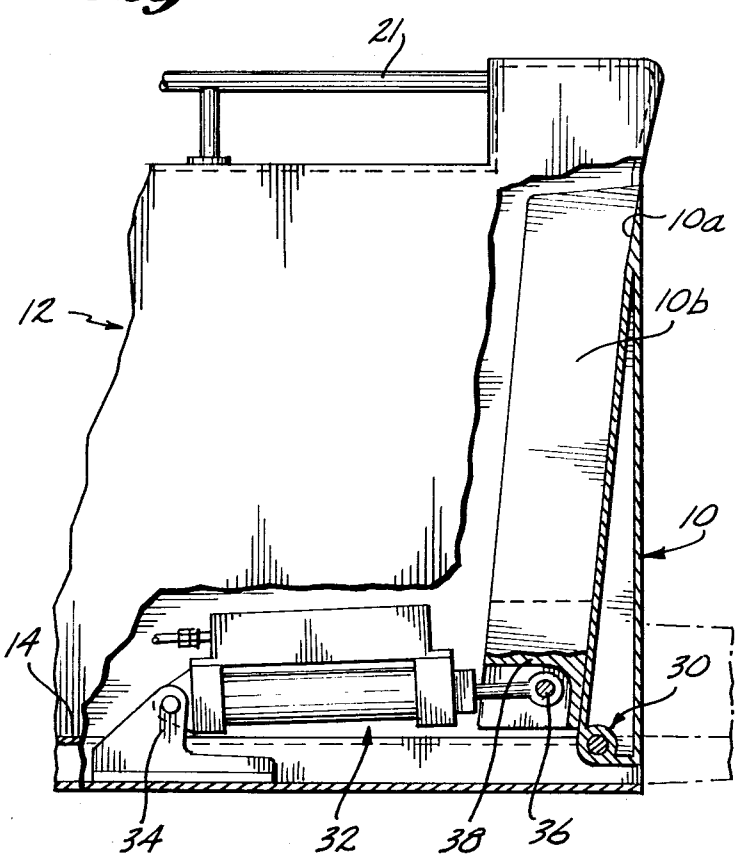
FIG. 13 is a side elevation showing the mechanism of FIG. 12.
Figure 12:
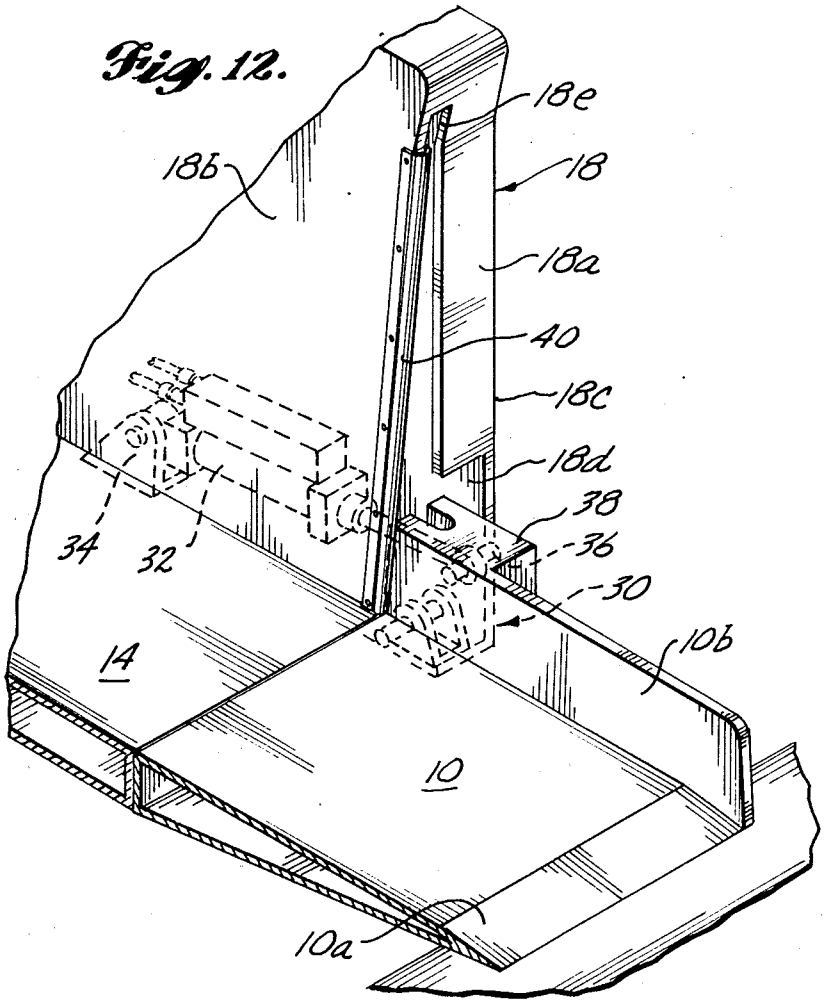
FIG. 12 is a view of one corner of the lift car illustrating a portion of the bridge, the mechanism for extending and retracting the bridge, and a safety switch mounted along an end edge of the lift car side adjacent the bridge.

As shown in FIGS. 12 and 13, bridge 10 is preferably of hollow dual-panel construction with a beveled free end 10*a* and with side rails 10*b*. Hingedly mounted onto the end of the lift car by hinge fittings 30, the bridge is movable between extended or lowered position in which its then upper surface is substantially flush with the upper surface of the lift platform 14, and an upraised or retracted position in which its then outer or endwise facing surface is substantially flush with the end panels of the lift car sides. One such end panel 18*a* is shown in FIG. 12. In order to extend and retract the bridge 10, hydraulic cylinder jack 32, housed between the inner and outer panels 18*b* and 18*c* of lift car side wall 18, is pivotally mounted at one end on a fitting 34 fixed to the interior base of wall 18. It is coupled at its opposite end to a pivot pin 36 mounted within a cowl or cover 38 at the base of bridge 10. The cover 38 adjoins the outer side of bridge rail 10*b* and serves to minimize the open corner space which the extended piston rod of jack cylinder 32 encloses with the bridge extended. A notch or a slot in the transverse end plate 18*a* of side wall 18 telescopingly accommodates the cowl 38 when the bridge is retracted by contraction of the hydraulic cylinder jack 32. Preferably, the end edge of the inner wall 18*b* is provided with an elongated pressure sensitive edge switch 40 having switch elements (not shown) connected in the control system of the apparatus. This switch constitutes a safety device of a well known type to arrest retraction of the bridge in the event a person or other obstacle is interposed between the retracting bridge and the end of car lift 18. A similar pressure switch is provided at the corresponding inner edge of the opposite wall 20. Such edges are preferably set back inclined from the end plane of the side walls 18 and 20 so as to receive the tapered bridge retracted into a nested position between the outside panels of side walls 18 and 20 (FIG. 13). Also, side wall end panel 18*a* (and the corresponding end panel of the opposing side wall 20) have a narrow vertical slot 18*e* which accommodates the plate-like bridge side rails 10*b* in the upraised position of the bridge.

Figure 5:
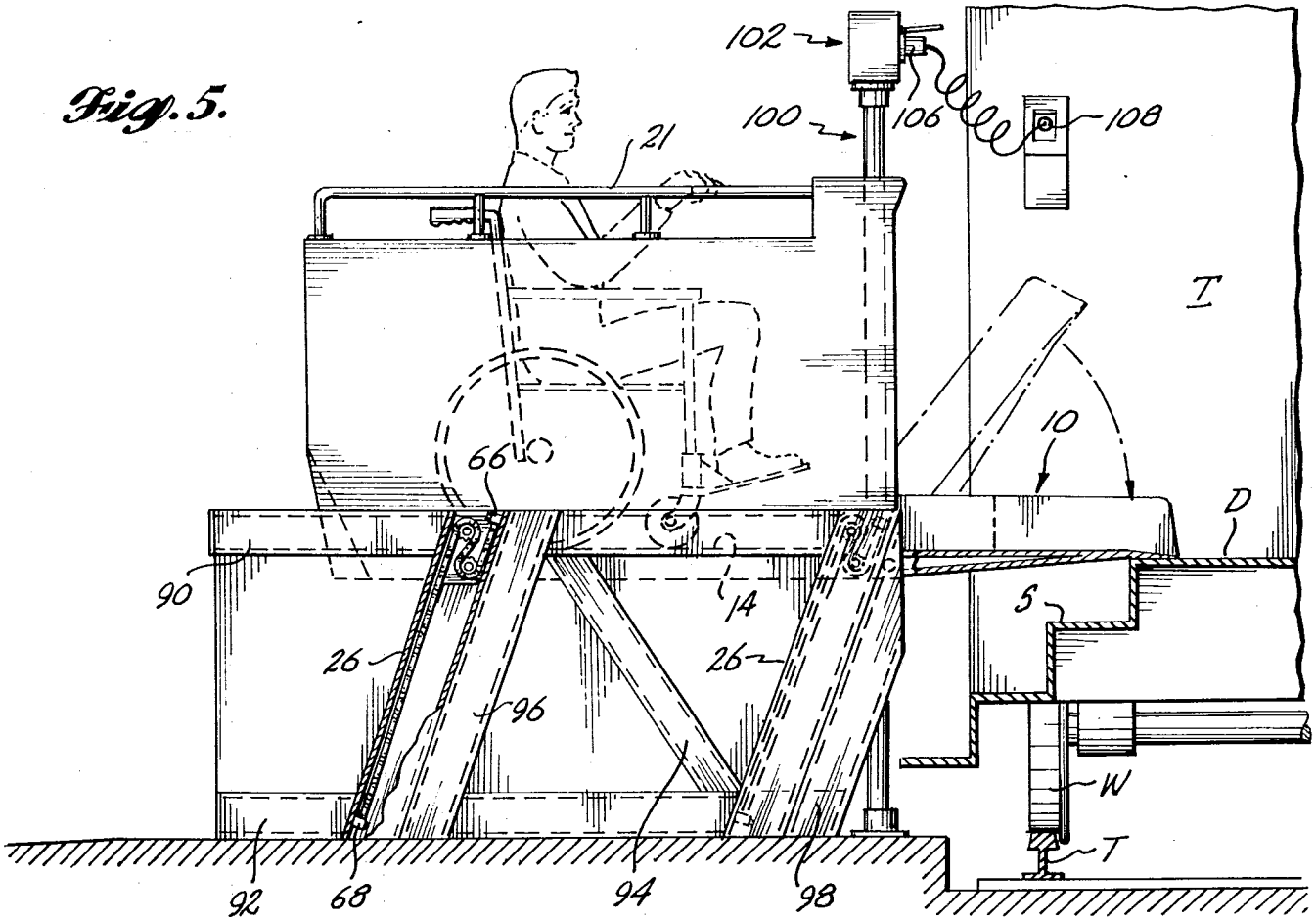
FIG. 5 is a view similar to FIG. 3, and at the same scale as FIG. 4.
Figure 10:
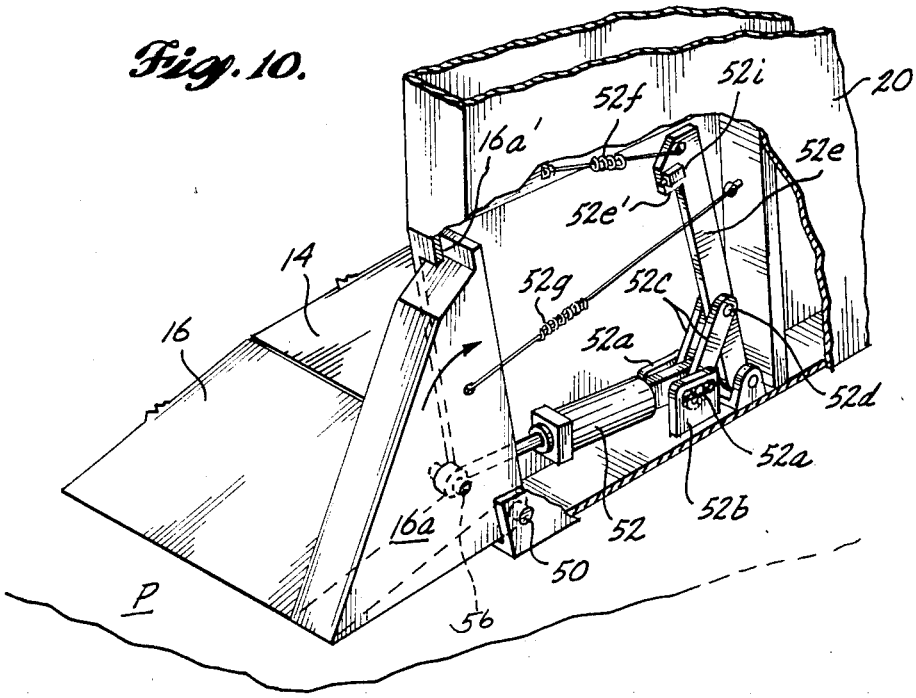
FIG. 10 is a perspective view of one corner of the lift car illustrating one end portion of the boarding ramp and the actuator means for extending and retracting the same.
Figure 11:
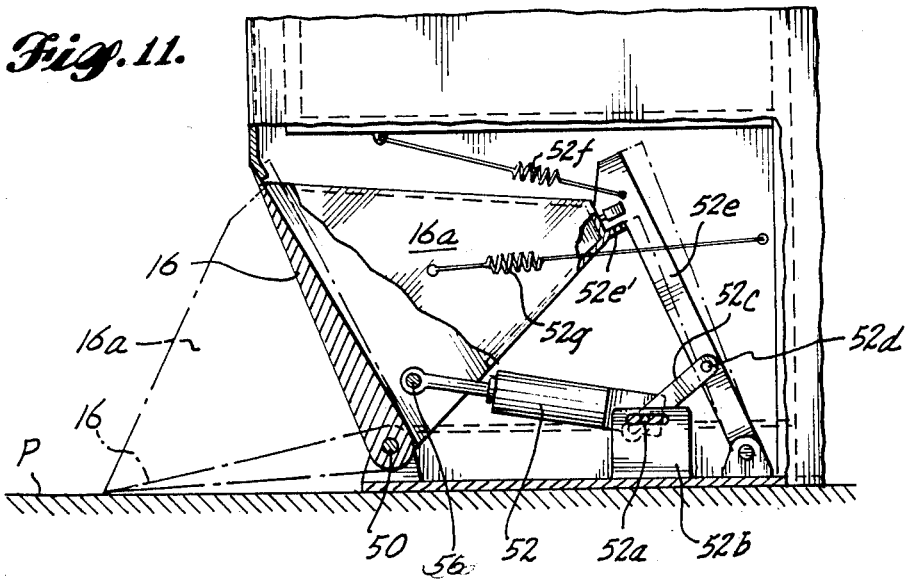
FIG. 11 is a side elevation view showing the mechanism of FIG. 10.

Referring to FIGS. 10 and 11, ramp 16 is of dual panel hollow wedge-shaped cross-section with its uppermost panel terminating at its butt end substantially flush with the floor surface of lift platform 14 with the ramp in its lowered or extended position. Hinged on a set of fittings 50 fixed to the bottoms of the lift car sides 18 and 20, the ramp 16 in raised or retracted position (FIG. 5, for example) provides a low end gate or closure for the lift car. Hydraulic cylinder jack 52, coupled by its base to a bracket 52*b*, is pivotally connected by its opposite end to the lug 56 upstanding from the base end of the ramp. As in the case of hydraulic cylinder jack 32 operating the bridge, the hydraulic cylinder jack 52 is protectively housed within the hollow interior of one of the lift car side walls, in this instance the side wall 20. Similarly, a hollow cowling or cover 16*a* encloses the portion of the hydraulic cylinder jack that protrudes from the car side wall 20 and is telescopingly received in the hollow of the side wall as the ramp is retracted.

The principal elements of elevator mechanism for raising and lowering the lift car are depicted in FIGS. 5 through 9. Four sliders 28, guided for sliding movement lengthwise in the channel-shaped guide tracks, carry the lift car. Each slider is positionally stabilized relative to the car by positioning bars (not shown) which make the sliders rigidly integral with the car so that they are held against rocking or shifting relative to the car platform. Each such slider comprises parallel plates of a synthetic plastic material such as polyethylene or polytetrafluorethylene ("TEFLON") which may, but need not, be joined together by one or more blocks 28*c* spacing the plates apart to accommodate between them two chain sprockets 60 and 62 and the stretches of a sprocket chain 64 with which the respective sprockets are in running engagement. The chain is stretched under tension extending generally lengthwise along opposite interior flange faces of the guide channel 26. The upper end of the chain is anchored by a fitting 66 to the upper end of the channel flange nearest the lift car bridge. The opposite end of the chain is similarly anchored by a fitting 68 to the lower end of the opposite flange. Sprocket 60 is rotatively journaled on shaft 60*a* extending through slider panels 28*a* and 28*b*. Sprocket 62 is likewise rotatively journaled on and is keyed to shaft 62*a* as a drive shaft passing through slider panels 28*a* and 28*b*. The substantial incline or slope of the respective guide tracks 26 causes the sliding bearing load contact imposed by the lift car on the respective sliders to be continuously borne by the inside faces of the channel flanges nearest the lift car ramp 10. It will be appreciated that this offers still another and special advantage of the sloping guide tracks, namely, essentially stable "rattle-free" motion of the lift car.

Figure 8:
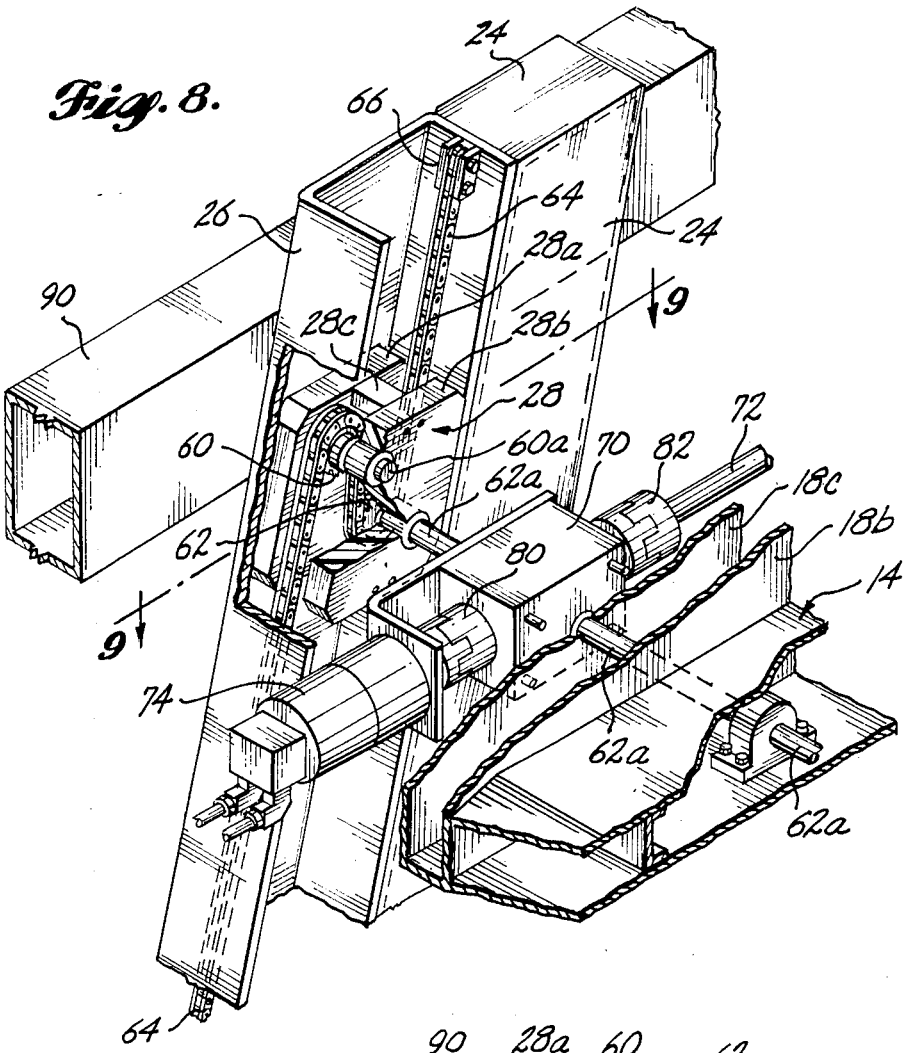
FIG. 8 is a perspective view taken on line 8—8 in FIG. 7 illustrating a portion of the lift car elevator drive mechanism.
Figure 9:
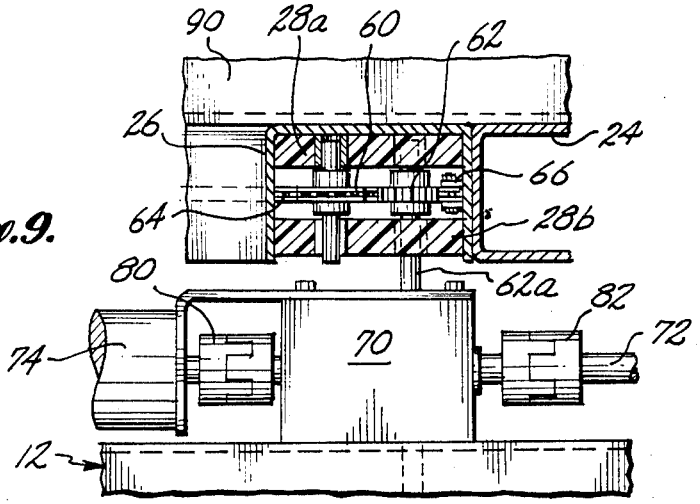
FIG. 9 is a sectional view taken on line 9—9 in FIG. 8.

In FIG. 8, shaft 62*a* is shown projecting through a gear housing 70 in which rotation of a drive shaft 72 by hydraulic motor 74 is converted into rotation of shaft 62*a* at right angles to shaft 72 through gearing (not shown) such as worm and wheel drive gearing, which is not reversible except when driven. As shown in FIG. 7, a second transmission gear unit 76 driven by shaft 72 converts rotation of the latter into rotation of shaft 78*a*. Keyed to elevator drive sprocket 78, shaft 78*a* is parallel to shaft 62*a* and terminates in a drive sprocket 78*b* in running engagement with a chain similar to chain 64 (FIG. 8). Similarly, shaft 62*a* terminates in a drive sprocket 62*b* to which it is keyed and which likewise engages a stretched chain similar to chain 64. A shock absorption coupling 80 is interposed between hydraulic drive motor 74 and the primary transmission drive gear unit 70, and a similar coupling 82 is likewise interposed between the output of such unit 70 and transfer shaft 72. Thus, shafts 62*a* and 78*a* are driven synchronously by the same mechanical drive power source (70) and the four corners of the lift car platform 14 are thereby maintained at the same height level above station platform P as the lift car is being raised and lowered between its terminal positions.

While other forms of elevator mechanisms may be employed, including other forms of chain and sprocket elevator mechanisms, that disclosed is preferred in its low-cost simplicity of construction, ready accessibility for maintenance and repairs and particularly in the quiet smoothness of starting and stopping of the lift car from the shock take-up action of the chains in their double reverse paths of encirclement around the adjacent sprocket.

The apparatus base carrying the four inclined guide tracks 26 comprises two parallel wall structures of hollow dual panel construction, also providing protective enclosure for various control and operating system components employed in the system. Such base wall structures comprise upper horizontally disposed box beams 90 supported above bottom horizontal box beams 92 by the inclined guide rails and also by the diagonally but oppositely inclined brace members 94. Additional structural members 96 and 98 parallel to the guide tracks 26 add stiffness and strength. The box beams 92 are bolted or otherwise rigidly secured to the station platform P at a distance separated sufficiently to accommodate the lift car and its associated drive mechanism (74, 70, 72, 76, etc.) between such base wall structures.

Adjacent to the lift apparatus is a control tower 100 comprising an upright post mounted adjacent the edge of the station platform P and carrying a control head 102 with a normally covered access socket 104 at its upper end. Typically, this control head 102 will be positioned about seven feet above the platform P so that the train operator or person who is to operate the lift apparatus from within the entryway of the train stopped in registry with the lift apparatus may reach out with a plug fitting 106 (FIG. 5) to connect the control head 102 to the control panel 108 in the passenger entryway of the train. Other means such as radio or infrared control links may be used to permit operation of the apparatus from the transit vehicle.

Figure 14:
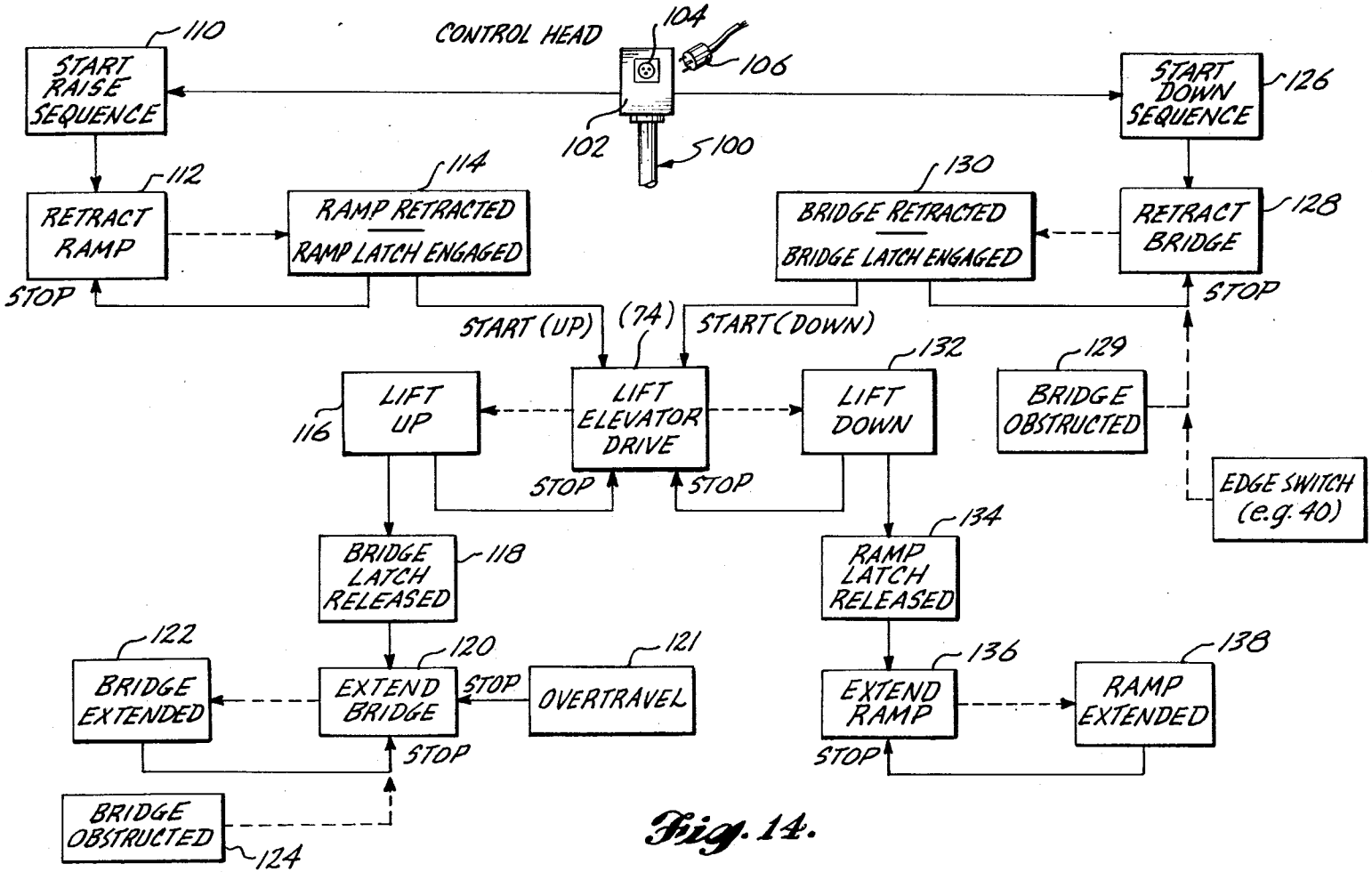
FIG. 14 is a simplified functional block diagram of the control and sequencing means for operating the apparatus in the preferred manner.

FIG. 14 depicts the operational system preferably employed in practicing the invention in its preferred functional or sequencing mode. The system includes an electrical switch or equivalent means 110 operable from the control head by a manually or automatically initiated control signal to start the operation of a device 112 for retracting the ramp 16. In the illustration, the ramp 16 is retracted by the hydraulic cylinder jack 52. Means 114 senses the point at which the retracting ramp reaches a retracted position and preferably in such response actuates a ramp latch to hold the ramp in elevated or retracted position. At the same time, the unit 114 transmits a starting signal to the lift elevator drive energizing the hydraulic motor 74 to start raising the lift car substantially to passenger vehicle deck level. Once the lift car reaches elevated position, a response by unit 116 stops the elevator drive and at the same time actuates a means 118 for releasing a bridge latch (not shown) and initiating operation of a bridge actuator 120 to lower or extend the bridge.

Descent of the bridge to its extended or lowered position is limited by its firm contact with vehicle deck D. This point is sensed by a means 122, to terminate operation of the bridge extender 120. If an obstruction prevents the bridge from reaching that lowered position, such as may occur if the passenger entryway of the train is not in correct registry with the lift apparatus, a unit 124 immediately terminates operation of the bridge extender mechanism 120 so as to avoid damage to equipment or injury to people. Preferably unit 124 is one and the same with unit 122. An overtravel sensor 121 in the form of a mercury switch mounted in the bridge responds to lowering of the bridge to an allowable limit such as 5 degrees below the horizontal to also terminate operation of mechanism 120.

The retraction or return cycle of the lift apparatus is similarly initiated from the control head 102, in this instance by transmitting a cycle start signal to the means 126 which first initiates operation of the means 128 for retracting the bridge. In the example, this means comprises the hydraulic cylinder jack 32. Full retraction of the bridge, sensed by the unit 130 actuates a bridge latch (not shown) to transmit a retraction stop signal to the retraction means 128. If an obstruction prevents the bridge from reaching its retracted position, either a unit 129 or one of the edge switches such as switch 40 immediately terminates operation of the retraction means 128. Upon full retraction of the bridge, unit 130 starts operation of the elevator drive 74 to lower the lift car. Suitable means 132 senses arrival of the lift car at its lowered or platform level position and terminates the elevator drive operation. At the same time, it actuates the ramp latch release 134 and initiates operation of the ramp extension mechanism 136 (jack 52). A position sensor means 138 senses ramp extension and stops the operation of the ramp extender jack. The wheelchair lift car 12 and its entry ramp 16 are then in readiness to discharge or to receive a passenger. As previously indicated, bridge 10 has meanwhile been latched in its retracted or raised position and it remains there until the lift car is once again raised to train deck level.

FIG. 15 illustrates schematically the means controlling ramp operation. In this illustration, it will be noted that the base end of hydraulic cylinder jack 52 has a pin **52*a* which is free to slide within an elongated slot in a bracket 52*b* secured to the base plate of platform 14 and within an elongated slot at one end of a link 52*c* whose other end is coupled by a pivotal mount 52*d* to a latch arm 52*e* that is pivotally mounted on the base plate of platform 14. A first extension spring 52*f* couples the upper end of latch arm 52*e* to side wall 20 and urges latch arm 52*e* toward hydraulic cylinder 52. A second extension spring 52*g* couples a portion of ramp 16 to side wall 20 and acts to restrain lowering of the ramp. With the ramp retracted, a tab 16*a*' on the upper end of its side cowl 16*a* is held by a notch 52*e*' on latch arm 52*e*. When, in order to lower the ramp, extension pressure is applied to hydraulic cylinder 52, the cylinder first extends. Since the ramp is restrained from lowering by spring 52*g*, the cylinder extension causes pin 52*a* to slide in the slot in bracket 52*b*. As a result, pin 52*a* bears on link 52*c* which exerts a force on latch arm 52*e* to move notch 52*e*' out of engagement with tab 16*a*'. When pin 52*a* reaches the end of the slot in bracket 52*b*, further extension of hydraulic cylinder 52 overcomes spring 52*g* so that the ramp thereafter lowers. The downward motion of the ramp is limited when tab 16*a*' abuts the rim of the opening in side wall 20. The tilt switch 52*h*** in the ramp serves to indicate, by whether its contacts are closed or not, that the ramp is either in its lowered position or is not.

During cylinder retraction for raising of the ramp 16, as the ramp reaches its elevated position, tab **16*a*' engages the notch 52*e*' by camming action, which serves to hold the ramp in its elevated position shown by broken lines in the figure. Limit switch 52*i* on latch arm 52*e*** serves to indicate, by whether its contacts are open or closed, that the ramp is either in its raised position and latched or it is not (the latter condition enabling the system to raise the ramp).

In the case of the bridge 10 and the functions of the units 122 and 124 shown in FIG. 14, hydraulic pressure fluid is delivered from a system pressure source through line **32*a* (FIG. 16) to the hydraulic cylinder jack 32 to extend the jack, such fluid passing through a flow restrictor 32*b*. The latter serves to provide a predetermined pressure differential thereacross when fluid is flowing through line 32*a* to extend the bridge 10. When the bridge makes firm contact with the passenger vehicle deck D, the resulting termination of fluid flow through line 32*a* causes the pressure differential across flow restrictor 32*b* to abruptly decrease so that the pressure at the lower side of flow restrictor 32*b* rises. This pressure rise is sensed by a hydraulic pressure switch 32*c* that performs the function of the unit 122 in FIG. 14. The same thing occurs in the event, during lowering or extension of the bridge 10, the bridge is forced into contact with the side of the train or with a person (or wheelchair) before the bridge can reach its lowered position. In that event, the resulting obstruction results in a response signal from the same pressure switch 32*c* which thereby performs the function of the unit 124 in FIG. 14. A second flow restrictor 32*d* in line 32*a* acts to limit rate of retraction of the bridge, whereas a third flow restrictor 32***f* in return line 32*e* limits rate of downward movement of the bridge.

In summarizing, the invention provides a safe and practical, efficient apparatus by which wheelchair passengers and other disabled persons are enabled to use public transit facilities without undue interruption of transit schedules and even without regard to the capability of such persons to safely operate control mechanisms. To save time, the apparatus encourages wheelchair passengers to take a ready position in the lift car ready for boarding the train the instant it arrives at the station, and the lift apparatus can be accessed for operation by the train attendant. This it does by protecting the individual while in the lift car awaiting the arrival of the train, such as against the possibility of flying rocks or other debris, windrush, and the normal apprehensions that must occur to a disabled person in the close presence of such commotion. With no passenger to board the arriving train, but with one in the train desiring to disembark, the lift car is still quickly raised to deck level and its bridge safely lowered to receive the departing train passenger. The apparatus is furthermore designed in such a way that severance of the connection to the control tower head 102 is disabling of all operating functions of the system such that children and vandals may not play with the apparatus when left unattended. If desired, the system may also be provided with added sensing apparatus positively holding the train braked or locked in standing position until the bridge 10 is retracted fully clear of the train entryway. Implementing this protection factor may be readily accomplished using any of existing state-of-art position detectors and train brake or drive controls responsive to the same so that the train control panel 108 held linked to the control head 106.

The embodiments of the invention in which an exclusive property or privilege is claimed are defined as follows:

1. A curbside lift for transferring wheelchair passengers between ground at curbside and the deck of a transit vehicle stopped with its pedestrian entryway aligned with said curbside lift comprising:

(a) a spaced pair of wall members defining a wheelchair passenger corridor alignable with the entryway of a stopped transit vehicle, each of said wall members housing elongate guide tracks, the elongate guide tracks housed in one of said wall members being aligned with the elongate guide tracks housed in the other of said wall members;

(b) a lift car positioned between said wall members, said lift car including:

(1) a wheelchair platform; and, (2) guided elements mounted on said wheelchair platform, said guided elements being mounted in said elongate guide tracks, said elongate guide tracks being positioned such that the combination of said elongate guide tracks and said guided elements controls the path of motion of said lift car between a lowered position substantially at ground level and a raised position substantially at transit vehicle deck level; and, (c) elevator means for supporting the loaded weight of said lift car and raising and lowering said lift car between said lowered position and said raised position, said elevator means including:

(1) driven chain-engaging sprockets rotatably mounted on said lift car and positioned in said elongate guide tracks;

(2) driving means coupled to said driven chain-engaging sprockets for rotating said driven chain-engaging sprockets in synchronism;

(3) idler chain-engaging sprockets rotatably mounted and positioned in said elongate guide tracks; and, (4) stretches of roller chains mounted in said elongate guide tracks, said stretches of roller chains being sized and positioned such that a stretch of roller chain partially encircles a pair of chain-engaging sprockets formed from one of said driven chain-engaging sprockets and one of said idler chain-engaging sprockets, said stretches of roller chains partially encircling their respective pairs of chain-engaging sprockets such that a Z-shaped reversal of direction occurs as the roller chain wraps around the pair of chain-engaging sprockets.

2. A curbside lift as in claim 1, wherein said guide tracks are mounted at an incline toward the end of said lift car proximate said deck of said transit vehicle.

3. A curbside lift as defined in claim 1 or claim 2 further comprising a bridge member including a panel element normally supported in an upright position and pivotally attached along the lower edge thereof to said lift car for rotating said bridge member between said upright position and a lowered position extending from said wheelchair platform to said deck of said transit vehicle.

4. Lift apparatus permitting a wheelchair passenger at ground level to board a transit vehicle having an elevated passenger deck and to return to ground level through a pedestrian entryway in the vehicle, said apparatus comprising:

a lift car movable between a position near ground level and a raised position near the level of the deck of said transit vehicle, said lift car having a wheelchair platform with protective upright sides and with first and second ends transverse to said sides, the second of which ends adjacently confronts the open passageway of the vehicle stopped with its entryway in register with the apparatus, at least one of said upright sides comprising upright, transversely spaced wall panels in parallel relationship;

self-supported base means for receiving said lift car;

a bridge mounted on said lift car to pivot about a transverse horizontal axis adjacent said second end, said bridge being normally in a retracted position and movable between said retracted position and an extended position when said lift car is in said raised position; in the retracted position, said bridge extending upright as a wall beteen said upright sides; in said extended position, said bridge projecting generally horizontally from said second end of said wheelchair platform and through the vehicle entryway to said vehicle passenger deck for traversal by a passenger in a wheelchair supported by said lift car;

elevator means, including interengaged elements mounted on said base means and on said lift car, for supporting said lift car and raising and lowering said lift car between said position near ground level and said raised position while maintaining said wheelchair platform substantially horizontal, said elevator means raising said lift car along a path of travel inclined toward said transit vehicle such that said lift car is advanced horizontally toward said transit vehicle as said lift car is being moved by said elevator means into said raised position, so as to reduce substantially, by the amount of said advancement, the distace to be spanned by said bridge between said wheelchair platform and said vehicle deck;

actuator means connected to the bridge for raising and lowering the bridge, said actuator means being housed between the transversely spaced wall panels of said lift car; and a protective cowl connected with the bridge and covering said actuator means, said cowl being telescopingly receivable between said wall panels as the bridge is raised from said extended position to said retracted position.

5. The lift apparatus as defined in claim 4, wherein the elevator means comprises means forming parallel, upright guide tracks arranged along respectively opposite sides of the lift car, said guide tracks being inclined in the direction toward a stopped transit vehicle, guided elements supporting the lift car and movably engaging the respective tracks for guided movement lengthwise of the tracks along the incline thereof, and motion-coordinated, reversible drive means on opposite sides of the lift car operable to raise and lower such guided elements, and thereby the lift car, along such guide tracks at equal rates so as to maintain the platform substantially level.

6. Lift apparatus permitting a wheelchair passenger at ground level to board a transit vehicle having an elevated passenger deck and to return to ground level through a pedestrian entryway in the vehicle, said apparatus comprising:

a lift car movable between a position near ground level and a raised position near the deck of said transit vehicle, said lift car having a wheelchair platform with protective upright sides and with first and second ends transverse to said sides, the second of which ends adjacently confronts the open passageway of the vehicle stopped with its entryway in register with the apparatus, said upright sides comprising upright, transversely spaced, wall panels in parallel relationship;

self-supported base means for receiving said lift car;

a normally retracted bridge mounted on said lift car and movable from a retracted position to an extended position projecting generally horizontally from said second end of said wheelchair platform and through the vehicle entryway to said vehicle passenger deck when said lift car is in a raised position for traversal by a passenger in a wheelchair supported by said lift car;

elevator means, including interengaged elements mounted on said base means and on said lift car, for supporting said lift car and raising and lowering said lift car between said position near ground level and said raised position while maintaining said wheelchair platform substantially horizontal, said elevator means raising said lift car along a path of travel inclined toward said transit vehicle such that said lift car is advanced horizontally toward said transit vehicle as said lift car is being moved by said elevator means into said raised position, so as to reduce substantially, by the amount of said advancement, the distance to be spanned by said bridge between said wheelchair platform and said vehicle deck;

a wheelchair boarding ramp mounted on said lift car to pivot about a transverse horizontal axis adjacent said first end of the platform between a retracted position extending upright as a wall between said upright sides and a lowered, extended position to serve as a ramp between the platform and ground;

respective actuator means connected to the bridge and to the boarding ramp for raising and lowering of such bridge and such ramp, said actuator means being housed between said transversely spaced wall panels; and a protective cowl connected with the bridge and covering the bridge actuator means, said cowl being telescopingly receivable between said wall panels as the bridge is raised from said extended position to said retracted position.

7. The lift apparatus defined in claim 6, wherein the elevator means comprises means forming parallel, upright guide tracks arranged along respectively opposite sides of the lift car, said guide tracks being inclined in the direction toward a stopped transit vehicle, guided elements supporting the lift car and movably engaging the respective tracks for guided movement lengthwise of the tracks along the incline thereof, and motion-coordinated, reversible drive means on opposite sides of the lift car operable to raise and lower such guided elements, and thereby the lift car, along such guide tracks at equal rates so as to maintain the platform substantially level.

8. Lift apparatus permitting a wheelchair passenger at ground level to board a transit vehicle having an elevated passenger deck and to return to ground level through a pedestrian entryway in the vehicle, said apparatus comprising:

a lift car movable between a position near ground level and a raised position near the level of the deck of said transit vehicle, said lift car having a wheelchair platform with protective upright sides and with first and second ends transverse to said sides, the second of which ends adjacently confronts the open passageway of a vehicle stopped with its entryway in register with the apparatus;

self-supported base means for receiving said lift car;

a normally retracted bridge mounted on said lift car and movable from a retracted position to an extended position projecting generally horizontally fro said second end of said wheelchair platform and through the vehicle entryway to said vehicle passenger deck when said lift car is in a raised position for traversal by a passenger in a wheelchair supported by said lift car; and means forming parallel, upright guide tracks arranged along respective opposite sides of the lift car, said guide tracks being included in the direction toward a stopped transit vehicle, guided elements supporting the lift car and movably engaging the respective tracks for guided movement lengthwise of the tracks along the incline thereof, and motion-coordinated, reversible drive means on opposite sides of the lift car operable to raise and lower such guided elements, and thereby the lift car, along such guide tracks at equal rates so as to maintain the platform substantially level, said apparatus including four such guide tracks, two adjacent each side of the lift car, said motion-coordinated, reversible drive means comprising four sprocket chains and upright means adjacent opposite sides of the lift car stretching said chains in fixed, parallel relationship to the respective guide tracks, chain sprockets in running engagement with such chains and rotatively mounted on the side of the lift car, and power means on the lift car, including interconnected shafts extending from the power means to the respective sprockets, for turning the same synchronously in one direction or the other by operation of said power means.

9. The lift apparatus defined in claim 8, and including a wheelchair boarding ramp mounted on the car to pivot about a transverse horizontal axis adjacent said first end of the platform between a retracted position extending upright as a wall between said upright sides and a lowered, extended position to serve as a ramp between the platform and ground.

10. The lift apparatus defined in claim 8, wherein said bridge is mounted on the lift car to pivot about a transverse horizontal axis adjacent said second end between a retracted position extending upright as a wall between said upright sides and said extended position.

11. The lift apparatus defined in claim 10, wherein at least one of the upright sides of said lift car comprises upright, transversely spaced wall panels in parallel relationship and housing between them, actuator means connected to the bridge for raising and lowering the bridge, a protective cowl connected with the bridge and covering said actuator means, said cowl being telescopingly receivable between said wall panels as the bridge is raised from said extended position to said retracted position.

12. The lift apparatus defined in claim 10, and including a wheelchair boarding ramp mounted on the car to pivot about a transverse horizontal axis adjacent said first end of the platform between a retracted position extending upright as a wall between said upright sides and a lowered, extended position to serve as a ramp between the platform and ground.

13. The lift apparatus defined in claim 12, wherein the upright sides of said lift car comprise upright, transversely spaced, wall panels in parallel relationship and housing between them, respective actuator means connected to the bridge and to the boarding ramp for raising and lowering of such bridge and such ramp, a protective cowl connected with the bridge and covering the bridge actuator means, said cowl being telescopingly receivable between said wall panels as the bridge is raised from said extended position to said retracted position.

14. The lift apparatus defined in claim 8, claim 10, claim 12, claim 9, claim 11, or claim 13, wherein the guided elements comprise sliders bearing slidably on the respective tracks and pressed downwardly by the weight of the car while being held and moved along such guide tracks by rotational positioning and turning of the sprockets engaging the chains.

* * * * *

UNITED STATES PATENT AND TRADEMARK OFFICE

CERTIFICATE OF CORRECTION

PATENT NO. : 4,576,539

DATED : March 18, 1986

INVENTOR(S) : Harold R. Williams

It is certified that error appears in the above-identified patent and that said Letters Patent is hereby corrected as shown below:

Column 10, line 52, "beteen" should be --between--
Column 11, line 3, "distace" should be --distance--
Column 12, line 45, "fro" should be --from--
line 52, "included" should be --inclined--
Column 13, line 1, "side" should be --sides--

Signed and Sealed this

*Second* Day of *September 1986*

[SEAL]

*Attest:*

DONALD J. QUIGG

*Attesting Officer*

*Commissioner of Patents and Trademarks*